US008038585B1

(12) United States Patent
Brown, Jr.

(10) Patent No.: US 8,038,585 B1
(45) Date of Patent: Oct. 18, 2011

(54) FLEXIBLE ELONGATED HANDHELD EXERCISE BARS

(76) Inventor: Gordon L. Brown, Jr., Anderson, SC (US)

( * ) Notice: Subject to any disclaimer, the term of this patent is extended or adjusted under 35 U.S.C. 154(b) by 42 days.

(21) Appl. No.: 12/561,319

(22) Filed: Sep. 17, 2009

Related U.S. Application Data

(60) Provisional application No. 61/097,632, filed on Sep. 17, 2008.

(51) Int. Cl.
*A63B 21/002* (2006.01)
*A63B 21/072* (2006.01)

(52) U.S. Cl. ..... 482/110; 482/92; 482/108

(58) Field of Classification Search ..... 482/44–46, 482/49, 50, 92, 93, 74, 106–110, 112, 148, 482/131, 82, 83; 463/47.2; 472/133; 446/422, 446/486

See application file for complete search history.

(56) References Cited

U.S. PATENT DOCUMENTS

| | | | | | |
|---|---|---|---|---|---|
| 83,228 | A * | 10/1868 | Warne | 463/47.7 |
| 897,201 | A * | 8/1908 | Gannon | 463/47.2 |
| 2,509,810 | A * | 5/1950 | Core, Jr. | 482/108 |
| 2,644,890 | A * | 7/1953 | Hollihan | 250/462.1 |
| 3,163,421 | A * | 12/1964 | Matyko | 473/594 |
| 4,218,057 | A * | 8/1980 | Wilson | 482/93 |
| 4,278,248 | A * | 7/1981 | Kifferstein | 482/74 |
| 4,480,828 | A * | 11/1984 | Kifferstein | 482/74 |
| 4,505,474 | A * | 3/1985 | Mattox | 482/82 |
| 4,651,985 | A * | 3/1987 | Salisbury | 482/122 |
| 4,743,016 | A * | 5/1988 | Van Derworp et al. | 482/93 |
| 4,964,630 | A * | 10/1990 | Curtiss | 482/50 |
| 4,986,535 | A * | 1/1991 | Hull et al. | 482/93 |
| 5,044,250 | A * | 9/1991 | Beyer | 84/422.4 |
| 5,147,262 | A | 9/1992 | Hymanson | 482/110 |
| 5,244,445 | A * | 9/1993 | Amesquita | 482/110 |
| 5,265,514 | A * | 11/1993 | Schertz | 84/422.4 |
| 5,312,314 | A * | 5/1994 | Stephan et al. | 482/110 |
| 5,364,325 | A * | 11/1994 | Matthews | 482/111 |
| 5,700,229 | A * | 12/1997 | Karnofsky | 482/83 |
| 5,820,531 | A * | 10/1998 | Choi | 482/93 |
| 7,704,198 | B2 * | 4/2010 | Brown, Jr. | 482/121 |
| 2005/0079962 | A1 | 4/2005 | Brown | 482/122 |
| 2005/0187075 | A1 * | 8/2005 | Bellamy | 482/93 |
| 2006/0079383 | A1 * | 4/2006 | Hermans | 482/109 |

* cited by examiner

*Primary Examiner* — Loan Thanh
*Assistant Examiner* — Victor K Hwang
(74) *Attorney, Agent, or Firm* — Joseph T. Guy; Nexsen Pruet, LLC

(57) ABSTRACT

A handheld flexible exercise device intended for human use in which an exercise device is held in each hand with each exercise device bending in response to the movement of an individual's hands and arms when performing an exercise such as walking or an aerobic exercise such as step aerobics. In addition, the flexible exercise device contains metal particles in the core of the device which will move back and forth freely inside the exercise device adding to the exercise benefits by increasing the weight and increasing resistance through the dynamic movement of the metal particles plus creating a noise that can allow an individual to achieve more benefit from an exercise such as walking to enhancing better coordination in the movement of one's hands and arms with the simultaneous movement of one's legs as in walking by trying to achieve a consistent noise level during the exercise.

12 Claims, 3 Drawing Sheets

FLEXIBLE ELONGATED HANDHELD EXERCISE BARS

CROSS-REFERENCE TO RELATED APPLICATIONS

The present application claims priority to U.S. Provisional Patent Application No. 61/097,632 filed Sep. 17, 2008 which is incorporated herein by reference.

BACKGROUND OF INVENTION

The present invention is related to an improved exercise device. More specifically, the present invention is related to a dynamic isokinetic oscillating exercise device preferably comprising a pair of flexible elongated elements wherein an element is held in each hand during use and the dynamic action of the device enhances the exercise.

There is a long standing desire to exercise and the benefits derived thereby are well known. Weight training is widely relied on yet this tends to cause strain on joints, particularly if done improperly, and unless great care is taken in weight training properly the muscles may not necessarily be trained in accordance with their normal use during daily activities.

Isokinetic exercises, and particularly isokinetic exercises using oscillating devices is beneficial, particularly, when used to enhance a normal activity such as walking wherein the motion of the isokinetic device augments the natural motion. An exemplary embodiment of an isokinetic device is described in U.S. Pat. No. 5,147,262. These devices, though beneficial, are only marginally successful since the motion is not synchronized with the motion of the user. As the user moves the device to cause deflection, the device desires to relax which causes the frequency of oscillation to be independent of the action of the user.

There is an ongoing desire for an isokinetic exercise device with a motion which is synchronized with the motions of the user thereby allowing the degree of resistance to be correlated to the actions of the user to augment an exercise motion regardless of the frequency of movement.

BRIEF SUMMARY OF THE INVENTION

It is an object of this invention to provide a two-piece elongated flexible exercise device which is preferably used with one piece carried in each hand while a person walks or performs other forms of aerobic exercise with the arms and hands moving in synchronization with the natural movement of one's feet.

A feature of the invention is that it is easy to assemble, comfortable to carry in one's hand and easy to use with the device bending in any direction when forces are transmitted to the exercise device thru movement of one's hands and arms.

An advantage of the present invention is that the device provides a dynamic oscillatory motion which is synchronized with the gait frequency of the user thereby providing resistance at natural intervals for maximum effectiveness.

Yet another feature of the present invention is that the effective resistance is more than the actual weight thereby allowing the user to carry a smaller weight in each hand for easier carrying but transmitting a larger effective resistance to the muscles of one's hands and arms for enhanced conditioning of one's muscles.

These and other advantages, as will be realized, are provided in an isokinetic dynamic exercise device for use in exercise of the human body having resistance to bending in any direction. The device has a flexible elongated tube with an interior cavity wherein the flexible elongated tube is sized to be held in a human hand during exercise. Particles are within the cavity wherein the particles occupy a portion of the volume of the cavity. A closure is on each of the ends of the flexible elongated tube.

Yet another embodiment is provided in a method for exercising comprising:

grasping with at least one hand an isokinetic dynamic exercise device wherein the exercise device comprises:

a flexible elongated tube comprising an interior cavity wherein the flexible elongated tube is sized to be held in a human hand during an exercise;

particles within the cavity wherein the particles occupy a portion of the volume of the cavity; and a closure on each of the ends of the flexible elongated tube; and moving at least one hand in a predetermined oscillating motion wherein the motion comprises a forward direction and a reverse direction wherein the particles move within the cavity during the forward motion and oppose an initial transition to the reverse motion.

DETAILED DESCRIPTION OF THE INVENTION

Figure 1:
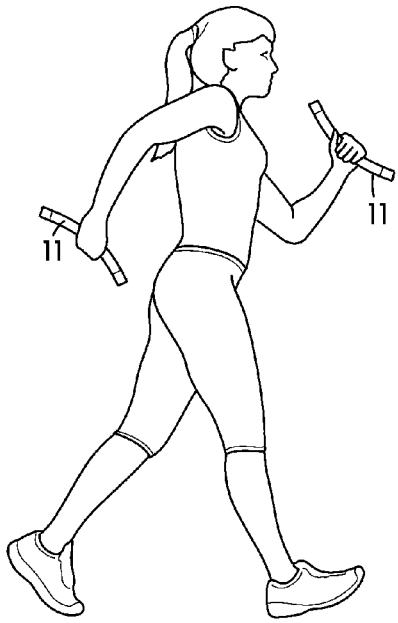
FIG. 1 schematically illustrates the invention in use.

The current exercise device preferably includes a flexible elongated tube having a preferably rounded interior with particles therein. The particles preferably at least partially fill the flexible elongated tube. It is preferred that the interior is filled less than full thereby allowing the particles to move and create a dynamic action as the arms and hands are moved.

An advantage of the present invention is that the degree of dynamic response can be easily adjusted by altering the gripping location. When the exercise device is held by the user's hands at or near the center a force is applied at an angle to the length of the device. When the exercise device is held or at or near the ends the device the end opposite the end that is grasped will readily bend in the intended direction thereby providing enhanced resistance due to the increase in the momentum of the exercise device by the bending of the end opposite the end that is grasped for strength training, conditioning and toning of the targeted muscles. The exercise device is held by the user's hands at a position along its length, and a force approximately parallel to the length of the device is applied, the metal pieces inside the flexible elongated tube will move back and forth inside the flexible elongated tube providing enhanced exercise benefit to the user. Flexing of the bar and dynamic movement of the particles inside the flexible elongated tube can occur simultaneously when the user holds the exercise device and moves the arms and hands in such as fashion that forces are transmitted to flex the device and allow dynamic movement of the particles.

If the exercise device is gripped near the center, relative to the long axis, the primary action is due to particle motion only. As the grip is moved towards the end additional force is included due to the bending motion which results in an increase in the momentum of the exercise device. Therefore, the degree of resistance increases with distance away from the center of the exercise device as will be more fully understood from the description herein.

In a particularly preferred embodiment the exercise device is used during exercise by placing an exercise bar in each hand. While walking, for example, one moves the arms and hands in coordination with the movement on one's feet. While performing other similar aerobic exercises, the hands and arms move in concert with the movement of one's feet to enhance the cardiovascular benefits of the exercise by raising one's heart rate over the level achieved by walking or performing other forms of aerobic exercise. The exercise device enhances the benefits of exercise including firming, strengthening and toning arm muscles, shoulder muscles, chest muscles, finger muscles and to a degree all the muscle groups of the upper body. The exercise device can be used in normal activities such as while walking or performing other forms of aerobic exercise with the only difference being having an apparatus in one's hand or hands and therefore augments the benefit of normal activities. This is an advantage compared with exercises which require a motion which as not typically done such as walking while swinging ones arms in a much larger arch than typically used while walking or pumping ones arms outward and inward during walking.

The invention will be described with reference to the accompanying figures which are appended hereto. The figures facilitate understanding the invention and the invention is not limited thereby. Throughout the various figures similar elements will be numbered accordingly.

FIG. 1 illustrates a schematic view of a user with an exercise device, 11, wherein the exercise device is held by the user during activities.

Figure 2:
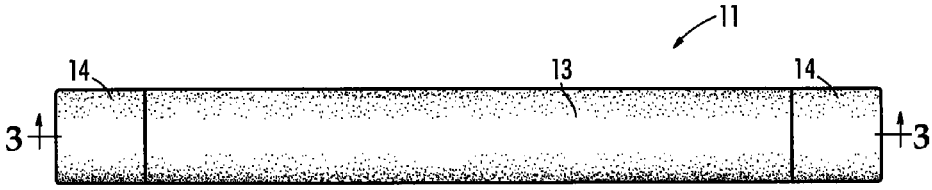
FIG. 2 is a schematic side view of an embodiment of the invention.
Figure 3:
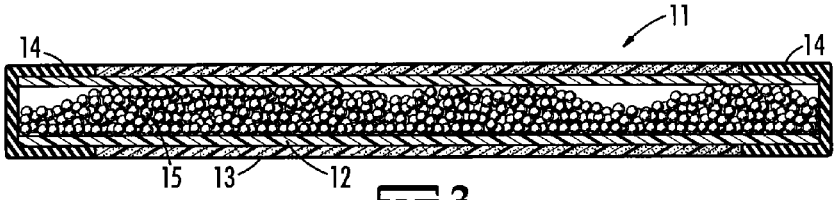
FIG. 3 is a cross-sectional schematic view taken along line 3-3 of FIG. 2.

A preferred embodiment is illustrated in schematic view in FIG. 2 and in cross-sectional view in FIG. 3 taken along line 3-3 of FIG. 2. In FIGS. 2 and 3 the exercise device 11, comprises a flexible elongated tube, 12. The flexible elongated tube has a cavity with particles, 15, therein. End caps, 14, act as closures thereby forming a cavity within the tube for securing the particles therein. An optional, but preferred sleeve, 13, provides a soft grip and an aesthetic appeal.

FIG. 2 shows the use of an end cap, 14, preferably of molded rubber, which fits flush with the ends of the sleeve, 13. The sleeve is preferably a soft foam plastic tubular material.

Figure 4:
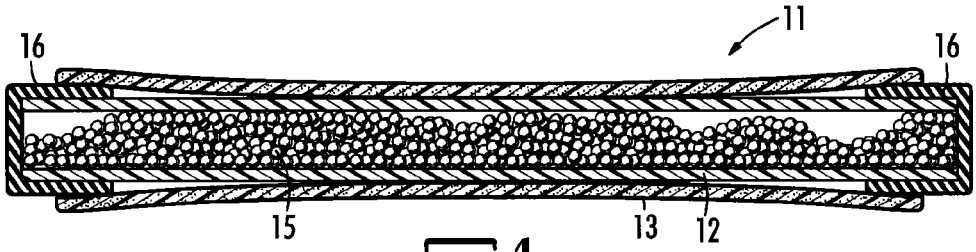
FIG. 4 is a cross-sectional schematic view of another embodiment of the invention.

FIG. 4 shows a construction similar to FIG. 3 except that the sleeve 13 extends over the end of an inner end cap, 16, such that the end cap is at least partially covered by the sleeve, 13. In one embodiment the end cap is a PVC end cap which is adhered to the flexible elongated tube, 12, by applying a PVC cement to the inside of the PVC end cap and inserting the flexible elongated tube, 12, into the open end of the PVC end cap forming an end closure.

A particularly preferred flexible elongated tube has an outside diameter of at least 0.50 inches to no more than 2 inches. The cavity preferably has a diameter of at least 0.4 inches to no more than 1.0 inch.

The exercise device preferably has an outside diameter of about 1.25 inches and is about 16 inches long. To accommodate a variety of needs for handheld exercise devices the length of the exercise device preferably has a length of from about 10 inches to about 20 inches and more preferably from about 13 inches to about 17 inches.

The device preferably has a weight of from about 0.5 pounds to about 3.0 pounds and a preferred outside diameter of between 0.5 inches and 2.0 inches. The flexible elongated tube preferably has low hysteresis characteristics for consistency.

The flexible elongated tube is preferably made from an extruded thermoplastic cylindrical material such as PVC. A particularly preferred flexible elongated tube is available from Jain Irrigation, Inc.; 1941 S. Vineyard Ave.; Ontario, Calif. 91761.

A particularly preferred sleeve is a soft foam plastic tubular material with a length of about 14 inches which fits flush with the end of the end cap.

In one embodiment the sleeve is a soft foam plastic tubular material available from Hunt-Wilde Corp. of Tampa, Fla. and is blown or slid over the outside of the flexible tube followed by application of one of the rubber end caps followed by insertion of the particles into the open end of the flexible tube after which the second end cap is applied. The sleeve, which is preferably a soft foam plastic tubular material, is preferably blown or slid over the outside of the flexible elongated tube preferably prior to insertion of the particles and application of the end caps.

It is preferred that the particles contained within the flexible elongated tube occupy less than 100% of the interior cavity and more preferable less than 99%. A void in the interior cavity provides a dynamic effect by the back and forth movement of the particles within the cavity of the flexible elongated tube. Movement of the particles are a result of forces applied with one's hands along the length of the exercise bar such that the particles will move back and forth inside the cavity of the flexible tube as the arms and hands move back and forth. This back and forth movement of the particles gives added exercise benefits due to the dynamic movement as well as allowing a person to maintain proper rhythm and synchronization between the movement of one's feet while walking and the simultaneous movement of one's hand because of the feel of the moving particles and the sound that the moving particles make as they move back and forth inside the flexible elongated tube.

Particles which are preferably metal, are placed inside the flexible elongated tube and secured inside the flexible elongated tube with end caps on each end. The sleeve is preferably added prior to the end caps. The particles are preferably a high density material with a density of at least 6 g/cm$^3$ and more preferably at least 10 g/cm$^3$. Steel is a particularly preferred particle. The particle is preferably approximately round in shape. The particles add weight to the exercise device and enable the exercise device to flex in a more responsive manner in response to the motion of one's arms and hands while engaged in the exercise activity such as walking. The particles also add bending resistance to the exercise device. When the particles take up less than 100% of the cavity the particles provide a dynamic movement in response to forces exerted upon the exercise device by the movement of one's hand in a back and forth manner. More preferably the particles occupy at least 50% to less than 100% of the volume of the cavity. Even more preferably the particles occupy at least 75% to less than 95% of the volume of the cavity. Most preferably the particles occupy at least 90% to less than 95% of the volume of the cavity. The percentage of volume occupied by the particles is defined as percent of total vertical distance along the central axis of the tube comprising particles. For example, with a 10 inch tube held vertically if 5 inches of the tube is occupied by particles the tube is considered to be 50% occupied. The movement of the particles can assist a person in creating a greater degree of coordination between the movement of one's hand and one's feet particularly in an exercise such as walking. The particles are preferably inserted by free-flow pouring.

The particles are preferably approximately round in shape and preferably a diameter at least 0.010 inches to no more than about 0.100 inches. A particularly preferred particle has a diameter of about 0.078 inches. In a preferred embodiment the particles will occupy about 93% of the interior space of the round section cavity of the flexible elongated tube with the weight of this volume of metal particles being about 0.50 pounds.

Particularly preferred particles are metal spheres provided as product code S-780 by Metaltec Steel Abrasive Company, 41155 Joy Road, Canton, Mich. 48187.

The end caps preferably have an internal length of 1 7/16 inches and an outside length of 1 11/16 inches. Particularly preferred end caps are molded rubber end caps available from Body Bar Systems, Inc. of Boulder, Colo. 80302. The inside of the end caps are preferentially adhered to the cut end of the flexible elongated tube using a cyanoacrylate adhesive such as Instant Krazy® Glue 'Advanced Formula' by Elmer's Products, Inc. of Columbus, Ohio 43219. Suitable end caps, such molded rubber end caps, are installed on the ends of the flexible elongated tube using either a tight friction fit and/or an adhesive to bond the inside of the end cap, 14, to the end and/or outside of the flexible elongated tube.

The exercise device preferably weighs at least about 0.5 pounds to no more than about 3.0 pounds. More preferably the exercise device weighs at least about 0.75 pounds to no more than about 1.5 pounds. The preferred length is at least about 10 inches to no more than about 20 inches and more preferably at least about 13 inches to no more than about 17 inches. This size and weight is easy and comfortably held by an individual by grasping the exercise device somewhere along its length. The device preferably has an outside diameter of at least about 0.75 inches to no more than 2 inches. The dimensions and weights are those which would fit in a hand comfortably and provide an adequate exercise under normal circumstances. The dimensions could be altered for advanced training or for diminutive individuals.

Figure 6:
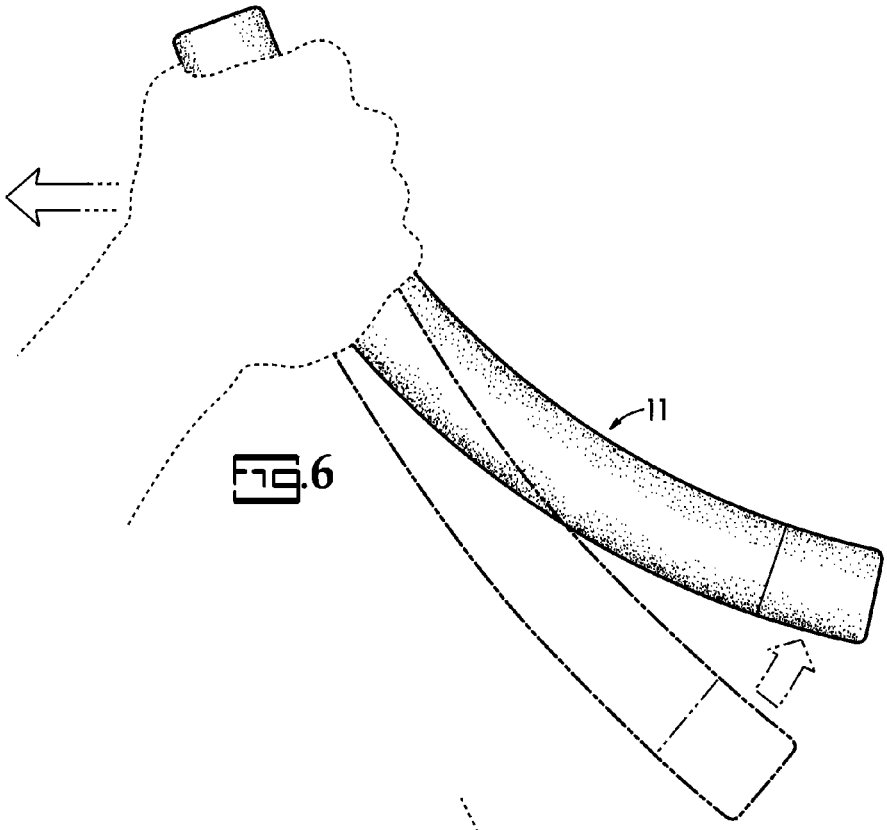
FIG. 6 schematically illustrates an advantage offered by the invention.

A particular advantage is gained by the dynamic action created by movement of the particles contained within the round flexible elongated tube. As a user moves the exercise device the particles inside move back and forth inside the flexible elongated tube in concert with the forward and backward movement of one's hand such that the exercise device does not bend significantly but moves in a way to allow this dynamic movement of the metal pieces inside the exercise device. The dynamic movement trails the movement of the hand and therefore as the momentum of the device is increased the resistance to reverse course increases. Further, as the device flexes or bends in concert with the movement of the hands and arms and/or the movement of the body the flexing of the exercise device produces a cushioned feel to the user. The movement of one's arm changing direction plus the flexing of the apparatus results in forces transmitted to one's joints that are more comfortable and less jarring than a typical device such as a dumbbell or other rigid weight that many people carry while walking or performing other forms of aerobic exercise. In addition the movement of one's arm changing direction and reversing course plus the flexing of the apparatus as in FIG. 6 along with the dynamic movement of the metal pieces inside the exercise device of FIG. 6 results in an increase in the momentum of the exercise device as the hands reverse course producing resistance forces which are primarily parallel to the horizontal forward and back movement of one's arm and these resistance forces are greater than the weight of the exercise device which results in enhanced conditioning of the muscles plus greater comfort for the user because the weight being carried by the person is equal to the just the weight of the exercise device.

The apparatus, when held at or near each end of the device by ones' hands, can be flexed into the shape of a semi-circle without the elongated device kinking or cracking the wall of the flexible elongated tube along its length, and further the apparatus returns to a straight or slightly bent condition upon removal of the forces that acted on each end of the device. The metallic pieces inside the flexible elongated device contribute to the increase amount of force it takes to bend the device because the metallic pieces rub against each other creating friction when the device bends.

The flexing of the device is unique due to the way in which the hands and arms move while one's feet are moving such as in walking or other aerobic activity such as Step Aerobics. In walking, as the left foot moves forward, one's right arm and hand naturally move forward and the same is true for the right foot and one's left arm and hand in a synchronized fashion between the movement of one's arm and hands as one's feet move in activities such as walking or aerobics such as Step Aerobics.

The hand and arm movements during an activity such as walking can be forward and back. Alternatively, the motion can be sideways relative to one's body moving away from and back to one's side. An alternative motion can initiate at the shoulder with the hand extending overhead and back to a shoulder position. The motion can initiate at the chest position with the arms and hands extending forward and then back to one's chest. Other movements where the individual can move the arms and hands in synchronization and in rhythm with the movement of one's feet are suitable for demonstration of the invention. One's arms and hands can move in the same direction and still be in synchronization with the movement of one's feet. Arm only exercises can be done such as a movement with both hands starting at the chest position and both arms and hands extending to a straight position overhead and then moving back together to one's chest.

The exercise device is preferably sufficiently durable to be bent to a maximum shape of a semicircle a minimum of 100,000 times without kinking or cracking of the flexible elongated tube or soft foam plastic sleeve while returning to an almost straight position after use.

Due to the preferred lack of any device, such as a flexible bar or rod, inside the flexible elongated tube along with the particles, the exercise device will have a slight bend at each end when held in the center by one's hand with the hand remaining stationary due to the added weight of the particles and the weight of the end cap.

A particularly preferred exercise device weighs about 1 pound and is preferably about 16.0 inches in length with an outside diameter of about 1.25 inches.

Figure 5:
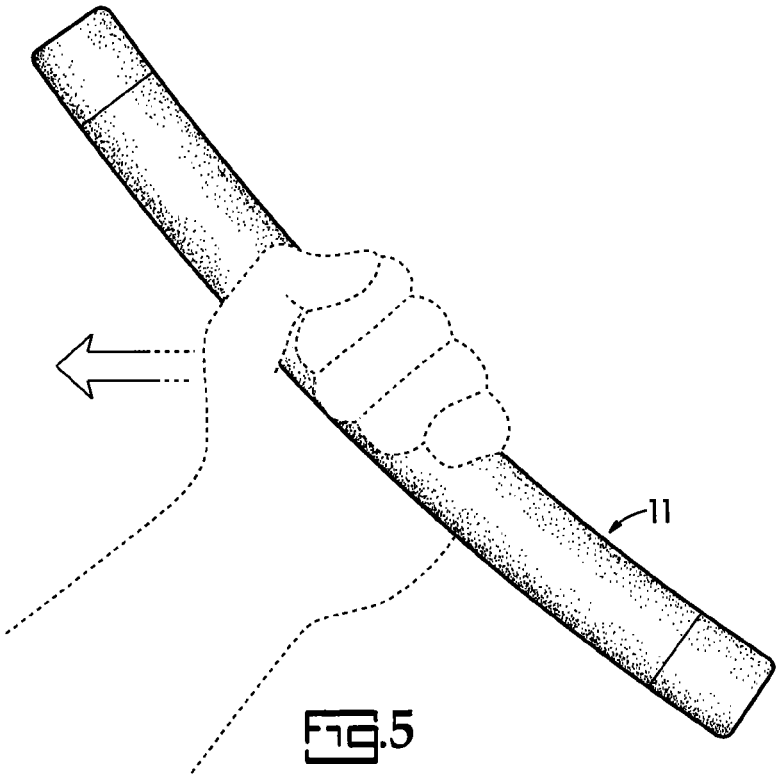
FIG. 5 schematically illustrates an advantage offered by the invention.

When the exercise device is held in the center by a hand and the hand moves back and forth the ends of the bar will bend partially as illustrated schematically in FIG. 5 wherein represented is the forward movement of one's hand as the hand and arm stop and start to move in the opposite direction. When the exercise device is held at or near one end of the exercise device the back and forth movement will cause the bar to bend more relative to being held in the center as illustrated schematically in FIG. 6 wherein represented is the forward movement of one's hand as the hand and arm stop and start to move in the opposite direction.

Figure 7:
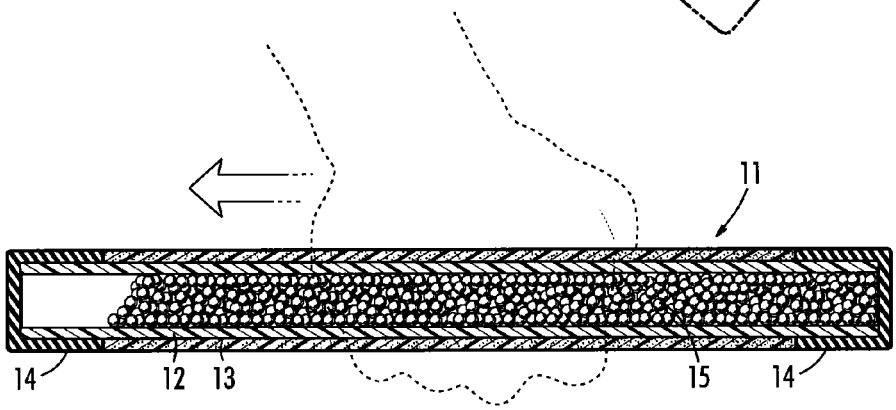
FIG. 7 schematically illustrates an advantage offered by the invention.

The dynamic component is illustrated schematically in FIG. 7 wherein the exercise device is held in the center and the hand has moved forward and stopped in preparation for reversing direction. The particles, 15, have moved to the right leaving the left end of the round section cavity of the flexible tube without metal particles. This movement of metal particles in response to the movement of the hand creates the dynamic action which is opposed to reversing direction thereby resulting in an increase in force. Further, the moving of the metal particles creates a noise that can help an individual create a better rhythm and synchronization between the movement of the hands and arms in conjunction with the movement of one's leg as in walking. Maintaining a consistent noise level can be interpreted as giving the individual constant feedback while one is walking and this feedback results in the proper movement of the arms and hands with the movement of one's feet. If the individual senses a change in the noise pattern then something has changed in either the movement of one's hands and arms or in the movement of one's legs.

An isokinetic dynamic exercise device is one which is a vigorously active or forceful exercise providing variable resistance to a movement at a constant speed.

EXAMPLES

Two bars were prepared in accordance with the present invention and tested at a room temperature of 77° F. Each bar was tested by bending followed by release of one end 10 times. Both bars were 16⅛" long. The first bar weighed 445 grams and the second bar weighed 442 grams. Before starting the test, the bar to be tested were held in their center and shaken back and forth a number of times in order to insure that the metal particles inside were agitated so if they had packed together they would be free to move. During the test procedure the bar was grasped at each end of the bar with one hand. Then the bar was bent so that both ends pointed down with the ends of the bar being parallel to each other for the start of the test. Once the ends of the bar were parallel one end of the bar was released and a 'stop watch' was started simultaneously. The unrestrained end of the bar moved toward the vertical direction and the stop watch was stopped when the free end of the bar moved ¾ the way to full vertical position which was about 135 degrees from the start position of zero degrees. The results of 10 tests using the first bar revealed an average of 2.76 seconds with a range between 2.11 seconds and 3.51 seconds. The results of 10 test using the second bar revealed an average of 3.20 seconds with a range between 2.76 seconds and 3.47 seconds. A visual position at about ¾ of the way toward vertical to stop was used for the measurement. The overall test showed a highly dampened bar which was slow to recover from a bent position. The slowness to recover from a bent position is in contrast to a composite rod such as a fishing rod or the pole used by a pole vaulter which will return to a straight position from a bent position very fast. Individual test data for the first rod was 3.51; 3.25; 2.78; 3.10; 2.58; 2.49; 3.02; 2.48; 2.32 and 2.11 seconds. Individual test data for the second rod was 2.86; 2.76; 3.26; 3.09; 3.30; 3.47; 3.08; 3.26; 3.29 and 3.63 seconds.

The invention has been described with reference to the preferred embodiments without limit thereto. One of skill in the art would realize additional embodiments and alterations which are not specifically set forth but which are within the metes and bounds of the claims which are appended hereto.

The invention claimed is:

1. An isokinetic dynamic exercise device for use in exercise of the human body, the isokinetic exercise device having resistance to bending in any direction comprising:

a flexible extruded thermoplastic elongated tube comprising a continuous interior cavity having two opposite ends, wherein said cavity has a diameter of at least 0.40 inches to no more than 1.0 inches and said interior cavity has a volume continuous between the opposite ends, wherein said flexible extruded thermoplastic elongated tube is sized to be held in a human hand during an exercise;

a plurality of spherical weight particles within said interior cavity, wherein said plurality of weight particles occupy a portion of said volume of said interior cavity to partially fill said interior cavity of said flexible elongated tube, a closure on each of said opposite ends of said flexible extruded thermoplastic elongated tube; and said isokinetic dynamic exercise device has a length between said opposite ends of at least 10 inches to no more than 20 inches, wherein the partial filling of said flexible elongated tube permits said plurality of weight particles to move dynamically within said interior cavity in response to dynamic forces exerted upon said isokinetic dynamic exercise device by a user moving said isokinetic dynamic exercise device in a back and forth manner, and providing isokinetic dynamic action to said isokinetic dynamic exercise device and user during use of said isokinetic dynamic exercise device for exercise.

2. The isokinetic dynamic exercise device of claim 1 wherein said particles move freely within said cavity in response to forces exerted upon said exercise device by movement of said hand in a back and forth manner.

3. The isokinetic dynamic exercise device of claim 2 wherein said particles occupy at least 50% to less than 100% of said cavity.

4. The isokinetic dynamic exercise device of claim 3 wherein said particles occupy at least 75% to no more than 95% of said cavity.

5. The isokinetic dynamic exercise device of claim 4 wherein said particles occupy at least 90% to no more than 95% of said cavity.

6. The isokinetic dynamic exercise device of claim 1 wherein said particles comprise metal.

7. The isokinetic dynamic exercise device of claim 6 wherein said metal particles have an outside diameter of at least 0.010 inches to no more than 0.100 inches.

8. The isokinetic dynamic exercise device of claim 1 wherein said length is at least 13 inches to no more than 17 inches.

9. The isokinetic dynamic exercise device of claim 1 with an outside diameter of at least 0.75 inches to no more than 2.0 inches.

10. The isokinetic dynamic exercise device of claim 1 further comprising a sleeve.

11. The isokinetic dynamic exercise device of claim 10 wherein said sleeve comprises a tubular foam.

12. The isokinetic dynamic exercise device of claim 10 wherein said sleeve at least partially overlaps at least one said closure.

* * * * *